US006178934B1

(12) United States Patent
Hirasawa et al.

(10) Patent No.: US 6,178,934 B1
(45) Date of Patent: Jan. 30, 2001

(54) SYSTEM AND METHOD FOR CONTROLLING INTERNAL COMBUSTION ENGINE

(75) Inventors: Takahiko Hirasawa; Mikio Matsumoto; Hatsuo Nagaishi, all of Yokohama (JP)

(73) Assignee: Nissan Motor Co., Ltd., Kawasaki (JP)

( * ) Notice: Under 35 U.S.C. 154(b), the term of this patent shall be extended for 0 days.

(21) Appl. No.: 09/433,882

(22) Filed: Nov. 4, 1999

(30) Foreign Application Priority Data

Nov. 19, 1998 (JP) ..... 10-329399

(51) Int. Cl.[7] ..... F01L 9/04
(52) U.S. Cl. ..... 123/90.11; 123/90.15
(58) Field of Search ..... 123/90.11, 90.12, 123/90.14, 90.15, 90.16, 90.17, 198 D

(56) References Cited

U.S. PATENT DOCUMENTS 5,060,604 * 10/1991 Seki et al. ..... 123/90.16
5,072,700 * 12/1991 Kawamura ..... 123/90.11
5,190,013 * 3/1993 Dozier ..... 123/481
5,596,956 * 1/1997 Ogawa et al. ..... 123/90.11
5,738,053 * 4/1998 Kato ..... 123/90.15
5,934,231 * 8/1999 Schmitz et al. ..... 123/90.11

FOREIGN PATENT DOCUMENTS 0 367 448 5/1990 (EP) .
0 777 038 6/1997 (EP) .
0 915 236 5/1999 (EP) .
61-247807 11/1986 (JP) .
7-317516 12/1995 (JP) .
10-47028 2/1998 (JP) .

* cited by examiner

*Primary Examiner*—Weilun Lo
(74) *Attorney, Agent, or Firm*—Foley & Lardner

(57) ABSTRACT

When a failure of a variable valve timing mechanism of an internal combustion engine is detected, both a cylinder which is associated with the mechanism in failure and another cylinder which has a symmetrical phase in operation to the above-mentioned cylinder with respect to the stroke cycle are brought into inoperative condition. At the same time, the amount of air/fuel mixture fed to the remaining cylinders is increased. With this measure, engine vibration and power drop are suppressed or at least minimized.

12 Claims, 4 Drawing Sheets

SYSTEM AND METHOD FOR CONTROLLING INTERNAL COMBUSTION ENGINE

BACKGROUND OF THE INVENTION

1. Field of the Invention

The present invention relates in general to control systems for controlling internal combustion engines equipped with a variable valve timing mechanism, and more particularly to the control systems of a type which can appropriately control the engine when the variable valve timing mechanism fails to operate normally.

2. Description of the Prior Art

Hitherto, in the field of internal combustion engines, for actuating intake and exhaust valves, various types of variable valve timing mechanisms have been proposed and put into practical use in place of conventional cam type mechanism. Japanese Patent First Provisional Publication (Tokkai) 61-247807 shows a variable type using electromagnetic solenoids, and Japanese Patent First Provisional Publication (Tokkai) 7-317516 shows another variable type using hydraulic actuators. In these variable types, the control for timing the valve opening and closing is carried out without providing the engine with a cam shaft. Japanese Patent First Provisional Publication (Tokkai) 10-47028 shows a measure for dealing with a malfunction of the variable valve timing mechanism which would occur in the type using the electromagnetic solenoids. That is, in the measure, upon detecting a malfunction of the valve actuating mechanism for one cylinder, operation of the intake and exhaust valves of the cylinder is stopped and the amount of air/fuel mixture fed to the remaining cylinders is increased. That is, in such case, operation of the engine is continued by the remaining cylinders.

However, when the engine operates with one cylinder being at rest, smoothed rotation of the engine is not obtained because of lack of balance of the rotation and thus marked vibration of the engine tends to occur. That is, when, upon detecting a malfunction of the variable valve timing mechanism, one cylinder is made inoperative, a torque that is to be produced by the cylinder is not actually produced during operation of the engine. This causes discontinuous production of engine torque and thus brings about the non-smoothed and vibratory operation of the engine.

SUMMARY OF THE INVENTION

It is therefore an object of the present invention to provide a system and a method for controlling an internal combustion engine equipped with a variable valve timing mechanism, which can smoothly operate the engine even when the valve timing mechanism fails to operate normally.

According to a first aspect of the present invention, there is provided, in an internal combustion engine equipped with a variable valve timing mechanism which variably controls operation timing of intake or exhaust valves of respective cylinders, a system for controlling the engine. The system comprises a first unit which detects a failure of the variable valve timing mechanism; a second unit which discriminates a first cylinder which is associated with the variable valve timing mechanism in failure; a third unit which discriminates a second cylinder whose inoperative condition would cancel a possible unbalanced rotation of the engine which would be caused by an inoperative condition of the first cylinder; a fourth unit which causes the first and second cylinders to take the inoperative conditions; and a fifth unit which increases the amount of air/fuel mixture fed to the remaining cylinders.

According to a second aspect of the present invention, there is provided, in an internal combustion engine equipped with a variable valve timing mechanism which variably controls operation timing of intake or exhaust valves of respective cylinders, a method for controlling the engine. The method comprises detecting a failure of the variable valve timing mechanism; discriminating a first cylinder which is associated with the variable valve timing mechanism in failure; discriminating a second cylinder whose inoperative condition would cancel a possible unbalanced rotation of the engine which would be caused by an inoperative condition of the first cylinder; causing the first and second cylinders to take the inoperative conditions; and increasing the amount of air/fuel mixture fed to the remaining cylinders.

According to a third aspect of the present invention, there is provided an engine controlling system in an internal combustion engine including a plurality of cylinders, a variable valve timing mechanism for each cylinder, a fuel injector for each cylinder and an ignition plug for each cylinder. The engine controlling system comprises a first unit which detects a failure of the variable valve timing mechanism; a second unit which, upon detection of the failure by the first unit, selects a first cylinder of the cylinders, which is associated with the variable valve timing mechanism in failure; a third unit which, upon selection of the first cylinder by the second unit, selects a second cylinder of the cylinders, whose operation has a phase substantially symmetrical to that of the first cylinder with respect to the stroke cycle of the engine; a fourth unit which, upon selection of the second cylinder by the third unit, makes the first and second cylinders inoperative; and a fifth unit which, upon making the inoperative condition of the first and second cylinders, increases the amount of air/fuel mixture fed to the remaining cylinders.

DETAILED DESCRIPTION OF THE INVENTION

Figure 1:
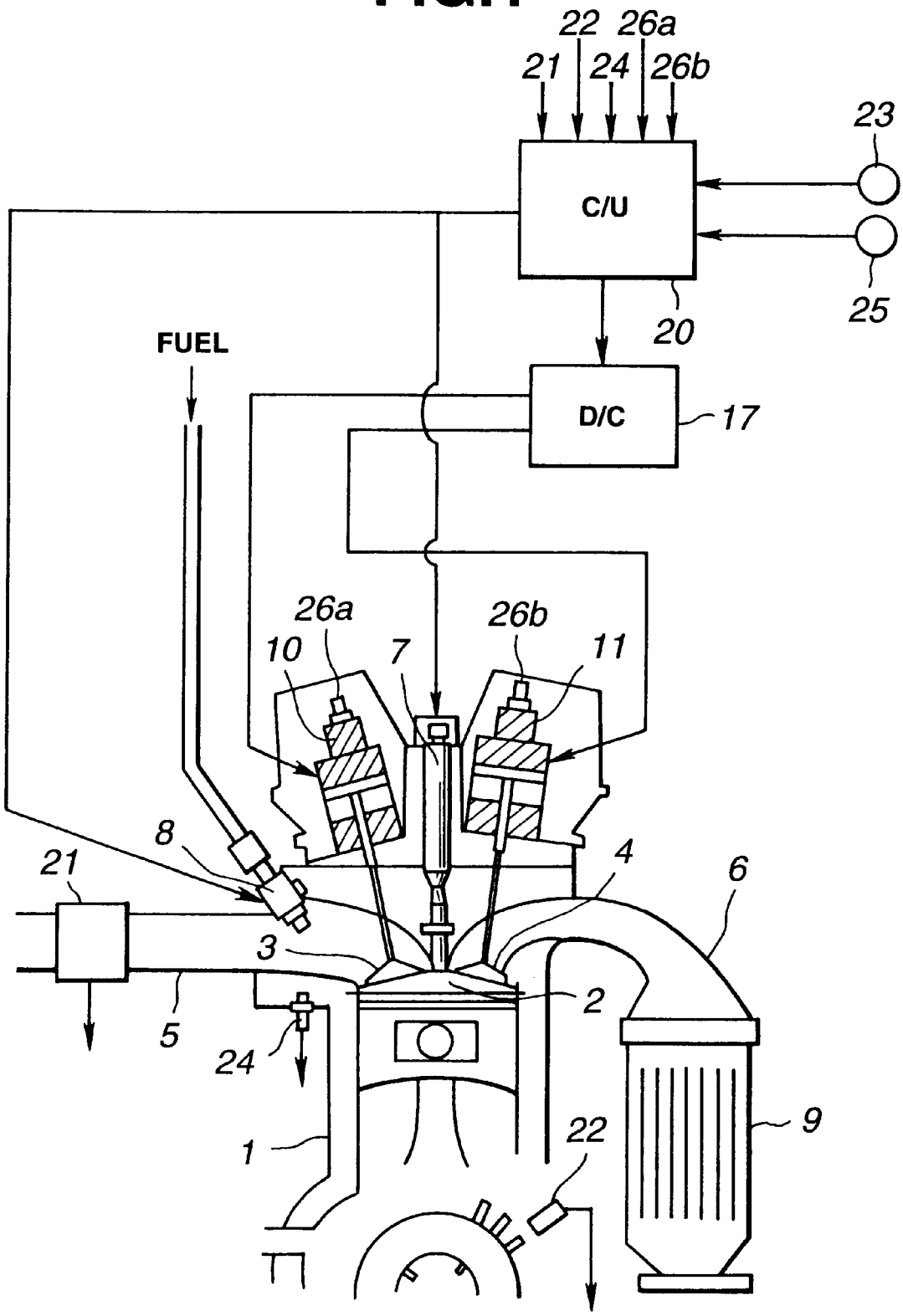
FIG. 1 is a schematic diagram of a system according to the present invention, which is applied to an internal combustion engine.

Referring to FIG. 1, there is schematically shown a system of the present invention, which is practically applied to an internal combustion engine 1 for a motor vehicle.

The engine 1 has cylinders 2 each having an upper portion serving as a combustion chamber. Each cylinder 2 is equipped with intake and exhaust valves 3 and 4. An intake port of each cylinder 2 is connected through an intake manifold to an air intake tube 5, and an exhaust port of each cylinder 2 is connected through an exhaust manifold to an exhaust tube 6. A catalytic converter 9 is connected to the exhaust tube 6 for purifying the exhaust gas from the engine 1. An ignition plug 7 is exposed to the combustion chamber of each cylinder 2, and a fuel injector 8 is exposed to the intake port of each cylinder 2.

The intake and exhaust valves 3 and 4 are actuated by variable valve timing mechanisms which are electromagnetic actuators 10 and 11 respectively.

Figure 2:
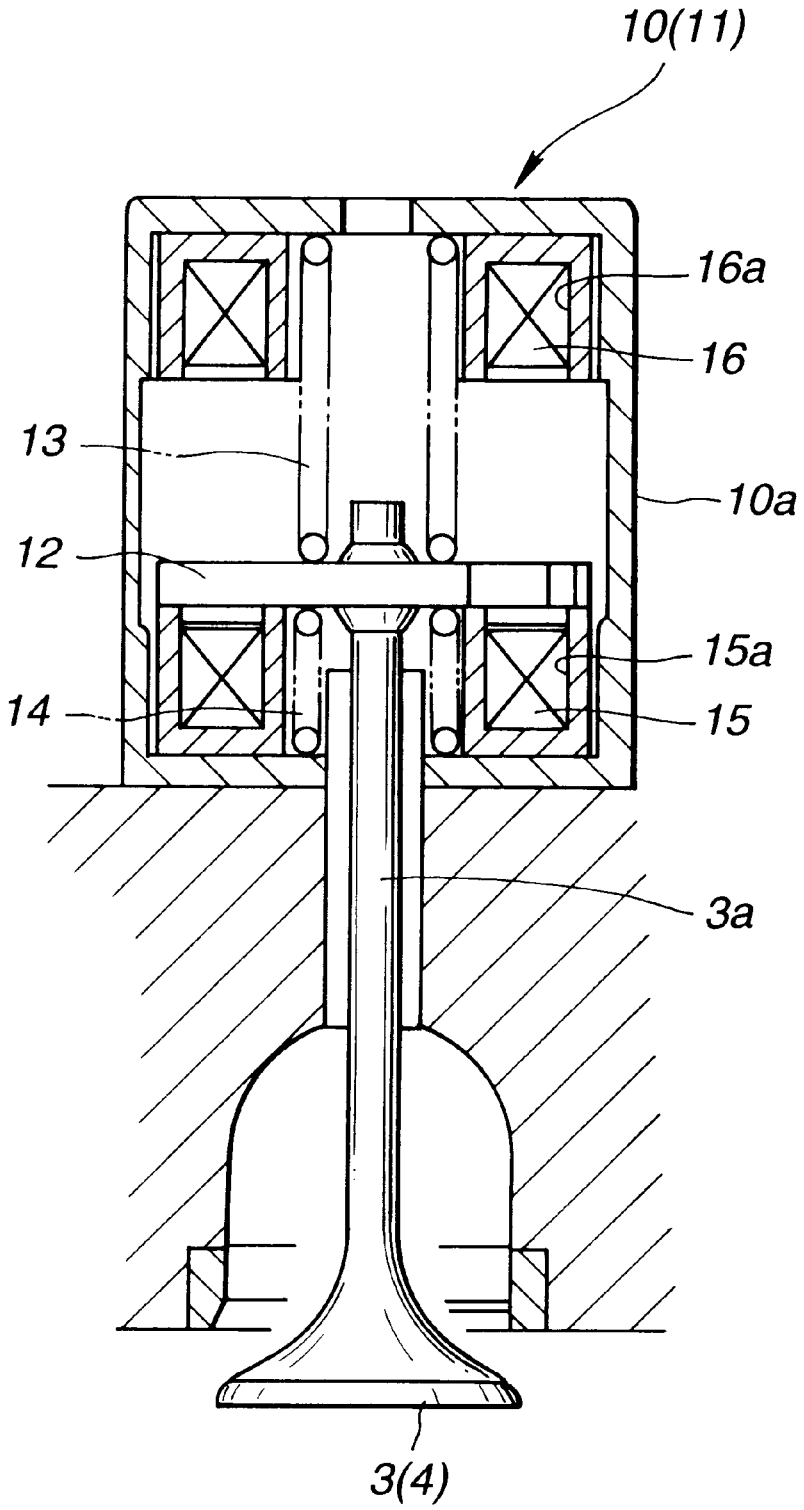
FIG. 2 is a sectional view of a variable valve timing mechanism employed in the engine to which the system of the invention is applied.

As is seen from FIG. 2, each actuator 10 or 11 comprises a case 10*a* mounted to a cylinder head of the engine 1, a moving plate 12 axially movably disposed in the case 10*a* and connected to a stem 3*a* of the valve 3 or 4, a first spring 13 arranged between an upper wall of the case 10*a* and the moving plate 12 to bias the moving plate 12 downward, that is, in a direction to induce an open position of the valve 3 or 4, a second spring 14 arranged between a lower wall of the case 10*a* and the moving plate 12 to bias the moving plate 12 upward, that is, in a direction to induce a close position of the valve 3 or 4, a first electromagnet 15 mounted on the lower wall of the case 10*a* and a second electromagnet 16 mounted beneath the upper wall of the case 10*a*. It is to be noted that the moving plate 12 is made of a material, such as iron or the like, which is attracted by a magnetic force.

When respective coils 15*a* and 16*a* of the first and second electromagnets 15 and 16 are deenergized and energized individually, the moving plate 12 is moved up to its uppermost position against the force of the first spring 13 allowing the valve 3 or 4 to assume the close position, while, when the respective coils 15*a* and 16*a* are energized and deenergized individually, the moving plate 12 is moved down to its lowermost position against the force of the second spring 14 allowing the valve 3 or 4 to assume the open position. When both the coils 15*a* and 16*a* are deenergized, the moving plate 12 is forced to take a neutral position by a balanced force produced by the first and second springs 13 and 14, and thus, the valve 3 or 4 takes a slightly open position.

Referring back to FIG. 1, the air intake tube 5 is equipped with an air flow meter 21 to detect a flow rate of air flowing therethrough. An air pressure sensor may be used as the flow meter 21. Information signal from the air flow meter 21 is led to a control unit 20. Information signals from a crank-angle sensor 22, an accelerator angle sensor 23, an engine coolant temperature sensor 24 and an intake air temperature sensor 25 are also led to the control unit 20. As is known, engine rotation speed can be derived from the crank angle. In place of the accelerator angle sensor 23, a throttle valve open degree sensor may be used, which detects the open degree of the throttle valve.

Lift sensors 26*a* and 26*b* are mounted on the electromagnetic actuators 10 and 11 to detect the open and close conditions of the intake and exhaust valves 3 and 4 respectively. Information signals from the lift sensors 26*a* and 26*b* are led to the control unit 20.

By processing the information signals led thereto, the control unit 20 prepares or produces various instruction signals which are applied to each fuel injector 8, each ignition plug 7 and a drive circuit 17 for the electromagnetic actuators 10 and 11. That is, the fuel injectors 8, the ignition plugs 7 and the electromagnetic actuators 10 and 11 are controlled in accordance with the instruction signals produced by the control unit 20.

As will be described in detail in the following, during operation of the engine 1, operation of the electromagnetic actuators 10 and 11 is monitored, and if the monitored operation reveals an abnormal operation of the actuators, the control unit 20 judges that there has occurred a malfunction in the electromagnetic actuators 10 and 11. Upon this judgment, the electromagnetic actuators 10 and 11 are deenergized and the associated ignition plug 7 and fuel injector 8 are rested for causing the associated cylinder 2 to become inoperative, and at the same time, electromagnetic actuators (10, 11) for another cylinder (2) selected from the remaining cylinders and associated ignition plug (7) and fuel injector (8) are also rested causing the selected cylinder (2) to become inoperative.

It is to be noted that the selected cylinder (2) is a cylinder whose inoperative condition can cancel the unbalanced rotation of the engine 1 which would be caused by the inoperative condition of the cylinder 2. That is, for example, a four cylinder in-line engine, upon detecting a failure of the electromagnetic actuators 10 and 11, a cylinder 2 which is associated therewith and another cylinder (2) which has a symmetrical phase in operation to the cylinder 2 with respect to the stroke cycle are brought to an inoperative state.

In the following, the control of the engine 1 at the time when a malfunction of the electromagnetic actuators 10 and 11 is found will be described with reference to the flowchart of FIG. 3.

At step S-1, judgment is carried out as to whether the electromagnetic actuators 10 and 11 operate abnormally or not. For this judgement, information signals from the lift sensors 26*a* and 26*b* and the crank-angle sensors 22 are used. That is, if the output from the lift sensor 26*a* or 26*b* at the time when the valve 3 or 4 takes an open or close position is different from a normal output provided at a corresponding time under normal operation of the engine 1, it is judged that the actuators 10 and 11 are operating abnormally. If NO at step S-1, that is, when the actuators 10 and 11 are operating normally, the operation flow goes to END. While, if YES, that is, it is judged that the actuators 10 and 11 are operating abnormally, the operation flow goes to step S-2. At this step, discrimination of a cylinder 2 which is associated with the abnormally operating actuators 10 and 11 is carried out. This discrimination is achieved by comparing the firing order of the cylinders with the crank angle indicated when the abnormal operation judgement is made.

At step S-3, discrimination of another cylinder (2) is carried out, whose inoperative condition can cancel or at least minimize the unbalanced rotation of the engine 1 which would be caused by the inoperative condition of the cylinder 2.

Figure 4:
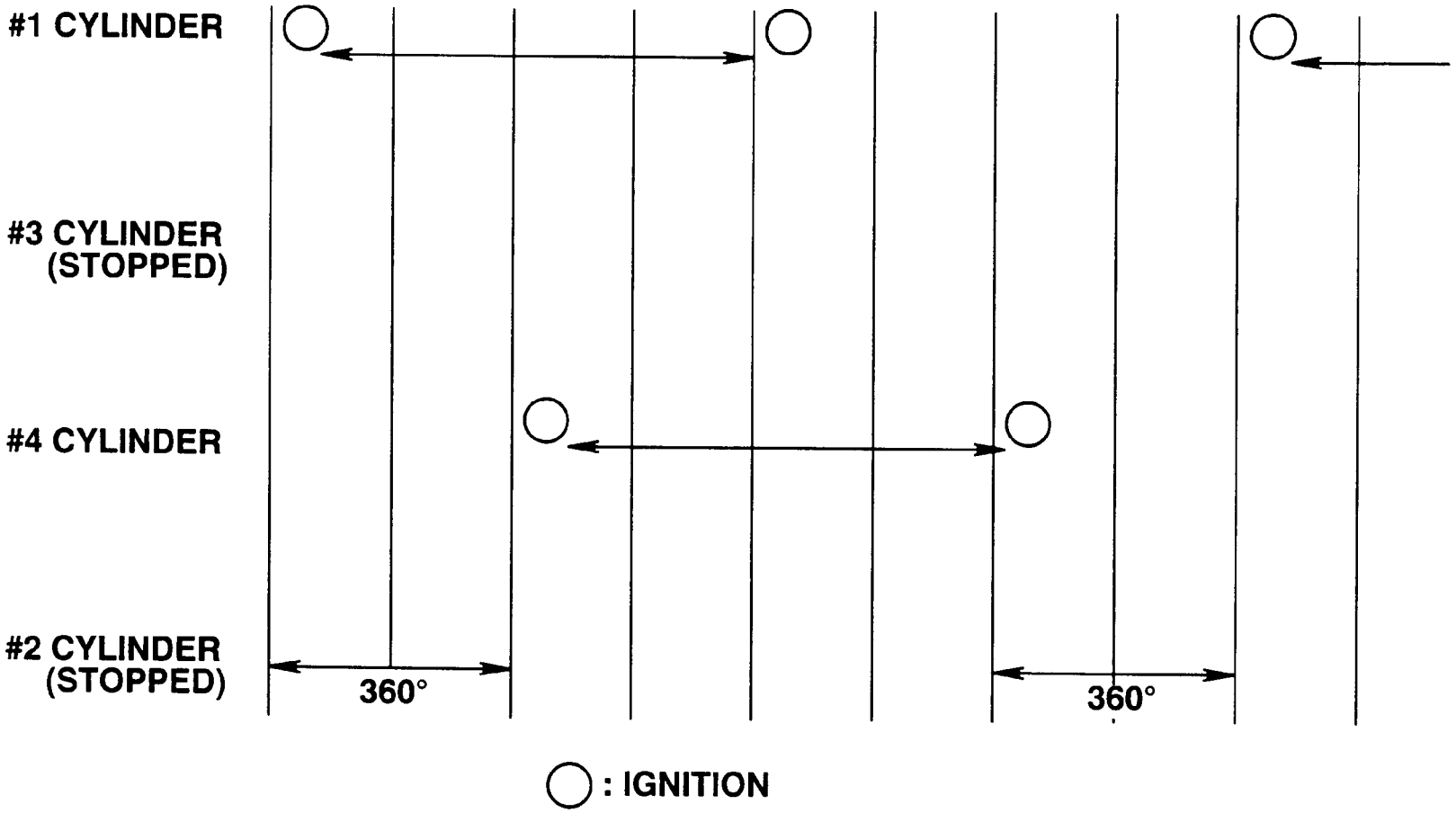
FIG. 4 is a timing chart showing the ignition timing of selected cylinders upon malfunction of the variable valve timing mechanism.

That is, in the four cylinder in-line engine, the cylinder (2) is a cylinder which has a symmetrical phase in operation to the cylinder 2 with respect to the stroke cycle or firing order. If, as is seen from the timing chart of FIG. 4, the firing order of the engine is #1-#3-#4-#2 and the actuators 10 and 11 of the second cylinder #2 fail to operate normally, the second cylinder #2 and the third cylinder #3 are brought to inoperative condition. In case of a six cylinder in-line engine, similar control is carried out.

If, in a V-6 engine, the firing order is for example #1-#2#3-#4-#5-#6, three pairs "#1-#4", "#2-#5" and "#3-#6" can be selected for the inoperative condition.

Figure 3:
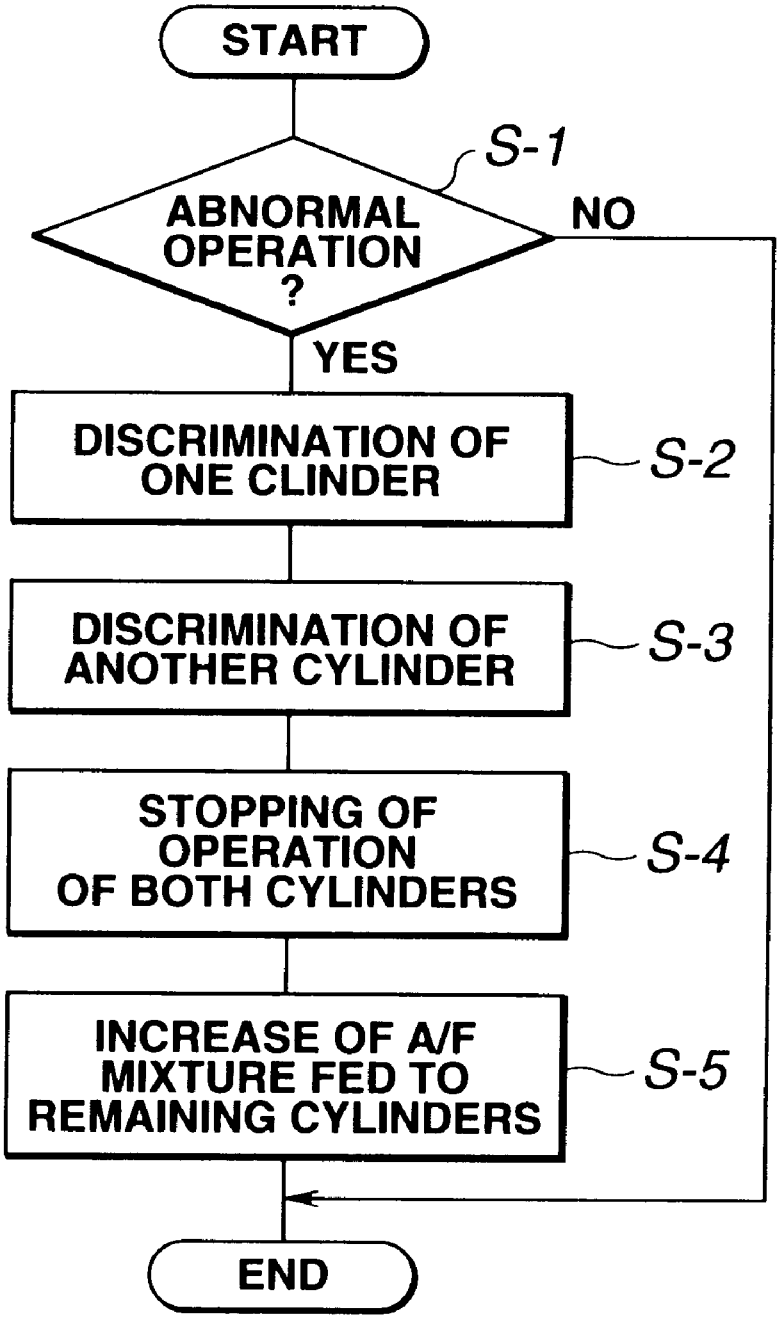
FIG. 3 is a flowchart showing programmed operation steps executed by a control unit employed in the system of the invention.

Referring back to the flowchart of FIG. 3, at step S-4, the operation of both the cylinders 2 and (2) is stopped. For this stopping, current feeding from the drive circuit 17 to the actuators 10 and 11 for the cylinders 2 and (2) is stopped and at the same time, the fuel injectors 8 and that of the ignition plugs 7 for the cylinders 2 and (2) are also stopped.

Then, at step S-5, the amount of air/fuel mixture fed to each of the remaining cylinders is increased by directing all the air to only the remaining cylinders and increasing the fuel injected from the fuel injectors of the remaining cylinders, and at the same time, the ignition timing is adjusted in accordance with the mixture increase. With this step, power drop of the engine 1 due to resting of the two cylinders 2 and (2) is suppressed or at least minimized.

As is mentioned hereinabove, in the four cylinder in-line engine, once a malfunction of the electromagnetic actuators 10 and 11 is detected, the engine is forced to operate as a two cylinder engine. Thus, in this case, to minimize power drop of the engine, the air/fuel mixture fed to each of the remaining cylinders is preferably made twice as much as that provided at the time when the engine operates normally. By delaying the closing timing of the intake valve (3) of each of the remaining cylinders, the amount of air led to the remaining cylinders is increased.

If desired, a warning lamp may be provided on a meter panel of the vehicle, which is lighted upon occurrence of the malfunction of the actuators 10 and 11 to let the driver know the malfunction.

In the following, entire operation of the engine 1 will be briefly described.

When electromagnetic actuators 10 and 11 for all of the cylinders of the engine operate normally, the engine 1 operates normally.

While, if, due to failure of the electromagnetic actuators 10 and 11, a normal operation of the intake or exhaust valve 3 or 4 is not carried out, the control unit 20 detects the failure based on the information signals from the lift sensors 26*a* and 26*b* and the signal from the crank angle sensor 22 as has been described hereinabove.

Upon detecting the failure, the control unit 20 stops operation of both a cylinder 2 associated with the actuators 10 and 11 and another cylinder (2) which has a symmetrical phase in operation to the cylinder 2 with respect to the stroke cycle. For stopping the operation of the cylinders 2 and (2), the coils 15*a* and 16*a* of the electromagnets 15 and 16 of each cylinder 2 or (2) are deenergized to cause the associated intake and exhaust valves 3 and 4 to assume a slightly open position, and at the same time, the associated fuel injectors 8 and ignition plugs 7 are forced to take their rest state.

Then, the control unit 20 increases the amount of air/fuel mixture fed to each of the remaining cylinders in the above-mentioned manner to suppress or at least minimize the power drop of the engine 1.

As is described hereinabove, upon failure of the variable valve timing mechanism (viz., electromagnetic actuators 10 and 11), a cylinder 2 associated with the disabled mechanism and another cylinder (2) which has a symmetrical phase in operation to the cylinder 2 are brought to a-stop or rest while carrying on operation of the remaining cylinders. Thus, as will be seen from FIG. 4, in the four (and also six and eight) cylinder engine, a so-called powerless ignition stroke (that is, an ignition stroke which fails to produce engine power) takes place at even intervals, which can reduce undesired engine vibration. That is, the powerless ignition stroke takes place at every 360° in crankshaft angle.

Upon resting of the two cylinders 2 and (2), the amount of air/fuel mixture fed to the remaining cylinders is increased and thus power drop of the engine 1 is suppressed or at least minimized.

Although the above-description is directed to an engine 1 using electromagnetic actuators 10 and 11 as a variable valve timing mechanism, the present invention is applicable to also an engine using a hydraulic type variable valve timing mechanism. As is known, the valve timing mechanism of this hydraulic type comprises generally a cylinder, a piston slidably disposed in the cylinder to define two hydraulic chambers in the cylinder, means for connecting the piston with an intake or exhaust valve, hydraulic circuits leading to the two hydraulic chambers from an oil pump and electromagnetic valves respectively disposed in the hydraulic circuits. For obtaining reciprocating movement, that is, open-and-close movement of the intake or exhaust valve, the electromagnetic valves are turned ON and OFF alternately under operation of the oil pump. Similar to the above-mentioned embodiment, when the electromagnetic valves fail to operate normally, a cylinder associated with the valves and another cylinder which has a symmetrical phase in operation to the cylinder are both stopped.

The entire contents of Japanese Patent Application P10-329399 (filed Nov. 19, 1998) are incorporated herein by reference.

Although the invention has been described above with reference to a certain embodiment of the invention, the invention is not limited to the embodiment described above. Various modifications and variations of the embodiment described above will occur to those skilled in the art, in light of the above teachings.

What is claimed is:

1. In an internal combustion engine equipped with a variable valve timing mechanism which variably controls operation timing of intake or exhaust valves of respective cylinders, A system for controlling the engine, comprising:

a first unit which detects a failure of said variable valve timing mechanism;

a second unit which discriminates a first cylinder which is associated with the variable valve timing mechanism in failure;

a third unit which discriminates a second cylinder whose inoperative condition would cancel a possible unbalanced rotation of the engine which would be caused by an inoperative condition of said first cylinder;

a fourth unit which causes said first and second cylinders to take the inoperative conditions; and a fifth unit which increases the amount of air/fuel mixture fed to the remaining cylinders.

2. A system as claimed in claim 1, in which said second cylinder discriminated by said third unit has a substantially symmetrical phase in operation to said first cylinder with respect to the stroke cycle of the engine.

3. A system as claimed in claim 1, in which said first unit detects the failure of the variable valve timing mechanism by analyzing the operation manner of said intake or exhaust valves with respect to a crank angle of the engine.

4. A system as claimed in claim 3, in which said first unit comprises:

a lift sensor which produces an information signal representing open and close conditions of said intake or exhaust valves; and a crank angle sensor which produces an information signal representing the crank angle of the engine, wherein the information signals from said lift sensor and said crank angle sensor are processed for detecting the failure of the variable valve timing mechanism.

5. A system as claimed in claim 1, in which said variable valve timing mechanism comprises:

a first electromagnet for causing each of the intake or exhaust valves to take an open position when energized;

a second electromagnet for causing each of the intake or exhaust valves to a close position when energized;

a first spring for biasing each of the intake or exhaust valves in a direction to induce the open position of the same; and a second spring for biasing each of the intake or exhaust valves in a direction to induce the close position of the same.

6. A system as claimed in claim 5, in which said fourth unit makes the variable valve timing mechanisms of said first and second cylinders inoperative so that the intake or exhaust valves of said first and second cylinders are kept in the slight open positions.

7. A system as claimed in claim 6, in which said fourth unit makes fuel injectors and ignition plugs of said first and second cylinders inoperative.

8. A system as claimed in claim 5, further comprising a sixth unit which adjusts ignition timing of the remaining cylinders in accordance with the increased amount of air/fuel mixture.

9. In an internal combustion engine equipped with a variable valve timing mechanism which variably controls operation timing of intake or exhaust valves of respective cylinders, a method for controlling the engine, comprising:

detecting a failure of said variable valve timing mechanism;

discriminating a first cylinder which is associated with the variable valve timing mechanism in failure;

discriminating a second cylinder whose inoperative condition would cancel a possible unbalanced rotation of the engine which would be caused by an inoperative condition of said first cylinder;

causing said first and second cylinders to take the inoperative conditions; and increasing the amount of air/fuel mixture fed to the remaining cylinders.

10. A method as claimed in claim 9, in which the detection of the failure of the variable valve timing mechanism is achieved by analyzing an information signal from a lift sensor, which senses open and close positions of one of the intake or exhaust valves, with respect to an information signal from an crank angle sensor which senses the crank angle of the engine.

11. A method as claimed in claim 10, in which the failure detection is made by judging whether or not the information signal issued from the lift sensor at the time when one of the intake or exhaust valves takes one of open and close positions is different from a reference information signal issued from the lift sensor at the corresponding time under normal operation of the engine.

12. In an internal combustion engine including a plurality of cylinders, a variable valve timing mechanism for each cylinder, a fuel injector for each cylinder and an ignition plug for each cylinder, a system for controlling the engine, comprising:

a first unit which detects a failure of the variable valve timing mechanism;

a second unit which, upon detection of the failure by said first unit, selects a first cylinder of the cylinders, which is associated with the variable valve timing mechanism in failure;

a third unit which, upon selection of the first cylinder by said second unit, selects a second cylinder of the cylinders, whose operation has a phase substantially symmetrical to that of the first cylinder with respect to the stroke cycle of the engine;

a fourth unit which, upon selection of the second cylinder by said third unit, makes said first and second cylinders inoperative; and a fifth unit which, upon making the inoperative condition of said first and second cylinders, increases the amount of air/fuel mixture fed to the remaining cylinders.

* * * * *